US008911049B2

(12) United States Patent
Thiemann

(10) Patent No.: US 8,911,049 B2
(45) Date of Patent: Dec. 16, 2014

(54) METHOD FOR ACTIVATING A PROCESSING DEVICE AND PROCESSING DEVICE ACTIVATED IN SUCH A WAY

(75) Inventor: Peter Thiemann, Munich (DE)

(73) Assignee: Océ Printing Systems GmbH, Poing (DE)

( * ) Notice: Subject to any disclaimer, the term of this patent is extended or adjusted under 35 U.S.C. 154(b) by 27 days.

(21) Appl. No.: 13/695,528

(22) PCT Filed: May 6, 2011

(86) PCT No.: PCT/EP2011/057289

§ 371 (c)(1),
(2), (4) Date: Oct. 31, 2012

(87) PCT Pub. No.: WO2011/144465

PCT Pub. Date: Nov. 24, 2011

(65) Prior Publication Data

US 2013/0050326 A1 Feb. 28, 2013

(30) Foreign Application Priority Data

May 18, 2010 (DE) ..... 10 2010 017 004

(51) Int. Cl.
*B41J 11/42* (2006.01)
*B65H 7/20* (2006.01)

(52) U.S. Cl.
CPC ..... *B65H 7/20* (2013.01); *B65H 2557/26* (2013.01); *B65H 2513/20* (2013.01); *B65H 2553/51* (2013.01); *B41J 11/42* (2013.01)
USPC ..... 347/14

(58) Field of Classification Search
CPC ..... B41J 29/38; B41J 11/42; B65H 2553/51
USPC ..... 347/14, 15
See application file for complete search history.

(56) References Cited

U.S. PATENT DOCUMENTS

| | | | | |
|---|---|---|---|---|
| 4,851,860 | A | 7/1989 | Mutoh | |
| 6,361,137 | B1 * | 3/2002 | Eaton et al. | 347/14 |
| 6,419,338 | B1 | 7/2002 | Ikeda | |
| 2011/0074854 | A1 * | 3/2011 | Saettel | 347/16 |
| 2012/0148324 | A1 | 6/2012 | Thiemann et al. | |

FOREIGN PATENT DOCUMENTS

| | | |
|---|---|---|
| DE | 4340164 | 6/1995 |
| DE | 69928882 | 12/2005 |
| DE | 102009038480 | 5/2011 |
| JP | 05024264 | 2/1993 |

* cited by examiner

*Primary Examiner* — Geoffrey Mruk
*Assistant Examiner* — Scott A Richmond
(74) *Attorney, Agent, or Firm* — Schiff Hardin LLP

(57) ABSTRACT

To activate a processing device which processes a surface of a moving work piece at regular intervals, wherein a predetermined time duration passes between an activation signal of the processing device and the processing on the surface, the movement of the work piece is sensed with a sensor that generates work pulses. A respective control pulse is generated if a predetermined number of work pulses has been generated. A number of the work pulses is repeatedly detected in a respective time interval that corresponds to the predetermined time duration. The activation signals are each generated at each control pulse of a series, and the activation signals are offset forward in time relative to the respective control pulse corresponding to the number of work pulses that have been detected in the respective time interval. The activation signals are output to the processing device.

7 Claims, 2 Drawing Sheets

METHOD FOR ACTIVATING A PROCESSING DEVICE AND PROCESSING DEVICE ACTIVATED IN SUCH A WAY

BACKGROUND

The present preferred embodiment concerns a method to activate a processing device which processes the surface of a moving web-shaped work piece at regular intervals, wherein a predetermined duration passes between an activation signal of the processing device and the action of the processing on the surface of the web-shaped work piece.

In particular, the preferred embodiment concerns a method to print a recording medium by means of an inkjet print head. An inkjet print head sprays small droplets of printing ink in the direction of the recording medium. These ink droplets require certain duration in order to strike the recording medium. This is the predetermined duration that passes between the activation signal of the print head and the action of the processing on the surface, namely the impact of the ink droplet on the recording medium.

In methods in which multiple subordinate workflows are to be interleaved with spatial accuracy on a web-shaped work piece, portions that cannot vary or cannot be varied corresponding to the movement velocity of the work piece produce a phase shift that varies with increasing velocity. This leads to a spatial deviation, and therefore to positioning, register or mounting deviations, for example.

In inkjet printing, the drop firing point in time is synchronized with the movement of the recording medium. The drop strikes the resting recording medium at a specific location of the web, in contrast to which a deviation corresponding to the web velocity arises at the maximum velocity of the recording medium. This deviation amounts to the web velocity multiplied by the clearance of the inkjet print head, divided by the drop velocity.

If the velocity is constant, a constant offset results that can be statically compensated. The print heads of the individual colors can thus be activated with corresponding compensation, and a print image that is in register can be generated. However, if printing takes place during an acceleration ramp, this offset builds gradually from zero to a maximum and produces a distortion of the print image. The print heads of the different colors are arranged at different locations, such that individual regions of the print image are subject to different distortions with regard to the different color separations. Significant register errors hereby result that far exceed the tolerance values allowed in practice.

In conventional printing devices, it is therefore for the most part not possible to implement a color printing during an acceleration or slowing phase.

A method for ink drop firing time control for an inkjet print device arises from U.S. Pat. No. 6,361,137 B1. In this method, the print head is moved by means of a carriage over the recording medium. Since the movement of the carriage superimposes with the movement of the ink fired from the print head, the ink is not fired vertically towards the recording medium but rather strikes the recording medium at an angle that depends on the velocity of the carriage. In this method, if a compensation of the movement of the print head also takes place, the posing of the problem explained above—in which a processing device must be synchronized with the movement of a web-shaped work piece—is different. This in particular applies if multiple processing devices act at different points of the web-shaped work piece.

Furthermore, a device and a method for scanning a web movement to control a processing process in which an incremental sensor is used to scan the web movement are disclosed in the subsequently published Patent Application DE 10 2009 038480 by the applicant. Given a backward movement (not provided per se) of the material web, the output of the signals generated by the incremental sensor are suppressed, and these are only output again when a forward movement follows the backward movement, wherein the path of the forward movement corresponds to the path of the previously executed backward movement. Only after this are the signals of the incremental sensor output again as control signals.

SUMMARY

It is an object to achieve: a method to activate a processing device which processes the surface of a moving, web-shaped work piece at regular intervals, wherein a predetermined duration passes between an activation signal of the processing device and the action of the processing on the surface of the web-shaped work piece, and a processing device with such a processing device, wherein the duration necessary for action at the surface should be compensated as simply and reliably as possible.

In a method and system to activate a processing device which processes a surface of a moving, web-shaped work piece at regular intervals, wherein a predetermined time duration passes between an activation signal of the processing device and the processing on the surface of the web-shaped work piece, the movement of the work piece is sensed with an incremental sensor that generates work pulses. A respective control pulse is generated if a predetermined number of work pulses that correspond to a predetermined path of the work piece has been generated, the path corresponding to the regular intervals to process the surface of the work piece. A number of the work pulses is repeatedly detected in a respective time interval that corresponds to the predetermined time duration. The activation signals are generated wherein each activation signal is generated at each control pulse of a series, and the activation signals are offset forward in time relative to the respective control pulse corresponding to the number of work pulses that have been detected in the respective time interval. The activation signals are output to the processing device.

DESCRIPTION OF PREFERRED EXEMPLARY EMBODIMENTS

Figure 1:
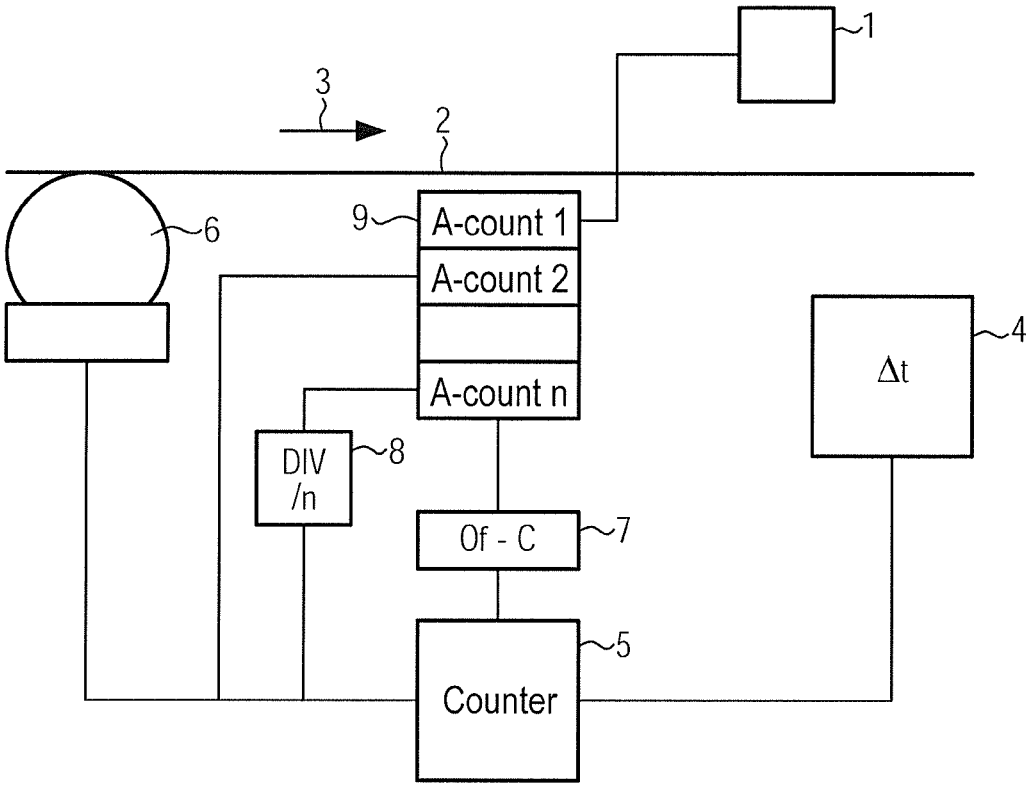
FIG. 1 is a device to activate a processing device according to a first exemplary embodiment, schematically in a block diagram.

For the purposes of promoting an understanding of the principles of the invention, reference will now be made to preferred exemplary embodiments/best mode illustrated in the drawings and specific language will be used to describe the same. It will nevertheless be understood that no limitation of the scope of the invention is thereby intended, and such alterations and further modifications in the illustrated embodiments and such further applications of the principles of the invention as illustrated as would normally occur to one skilled in the art to which the invention relates are included.

The method according to an exemplary embodiment to activate a processing device which processes the surface of a moving, web-shaped work piece at regular intervals, wherein a predetermined duration passes between an activation signal of the processing device and the action of the corresponding processing on the surface of the web-shaped work piece, comprises the following steps:

sense the movement of the web-shaped work piece with an incremental sensor that generates the work pulses, and generate a respective control pulse if a predetermined number of work pulses that correspond to a predetermined path of the web-shaped work piece has been generated, wherein this path corresponds to the regular intervals to process the surface of the work piece, such that a series of control pulses is generated, repeatedly detect the number of work pulses in a time interval that corresponds to the predetermined time duration, with which the processing device acts with a delay on the surface of the work piece, generate an activation signal, wherein an activation signal is respectively generated at each control signal of the series of control pulses, and the activation signals are offset forward in time relative to the corresponding control pulse, corresponding to the number of work pulses that have been detected in the preceding time interval, and output the activation signals to the processing device.

The movement of the web-shaped work pieces is sensed with an incremental sensor that generates work pulses. Using the work pulses, a control pulse is respectively generated when a predetermined number of work pulses has been generated, which number corresponds to a predetermined path of the web-shaped work piece that in turn corresponds to the regular intervals to process the surface of the work piece. This means that the control pulses are generated at time intervals that the web-shaped work piece requires in order to traverse such a regular interval between which the surface of the web-shaped work piece is to be processed. In other words: this means that a control pulse is generated when the web-shaped work piece has respectively traveled a distance that corresponds to the regular interval of two successive processing procedures on the work piece. The time interval of the control pulses varies depending on the velocity with which the web-shaped work piece is moved. At a lower velocity, it takes longer for the web-shaped work piece to travel this regular interval, in contrast to which the corresponding time interval is shorter at a higher velocity. However, according to the exemplary embodiment the output of these control pulses to the processing device to activate the corresponding processing is corrected in that the control pulses are output corresponding to the number of work pulses detected that were output earlier within the predetermined time period.

Via the use of an incremental sensor, the movement of the web-shaped work piece can be detected very simply and precisely, and the predetermined time duration that is necessary until the processing device acts on the surface of the work piece after a corresponding activation can also be provided very simply. Via the detection of the number of work pieces within this time interval, the method is thus provided with a variable that can be detected very simply on the one hand and on the other hand very precisely reflects the spatial offset of the action of the processing device due to the delay of the action. The delay of the processing is thus compensated exactly via the output of the control pulses earlier by the corresponding number of work pulses. It is thus possible to activate multiple processing devices with this method, wherein at different velocities of the web-shaped work piece the individual processing procedures of the individual processing devices act at regular intervals at exactly the desired locations on the work piece. The processing by means of the processing device can thus take place during the acceleration or during the slowing of the web-shaped work piece, without positioning, registration or mounting deviations occurring.

The method according to the exemplary embodiment is advantageously used to activate a printing device with an inkjet print head. It has been shown that a web-shaped recording medium can be printed with the method according to the exemplary embodiment both during the acceleration phase and during the slowing phase, without registration deviations occurring in a multicolor printing. Since the printing procedure can be executed both during acceleration and during slowing of the recording medium, the waste product is significantly reduced in comparison to conventional methods. Furthermore, it is possible to halt a printing procedure in the region of the print image and to continue it again, wherein the print image is printed continuously and correctly. This in particular applies in connection with the method explained above according to DE 10 2009 038480.

In a development of the method according to the exemplary embodiment, it is provided via the generation of synchronization pulses with a time interval that corresponds to the predetermined duration that passes between the activation of a processing device and the corresponding processing on the surface of the web-shaped work piece.

The number of work pulses that have been generated between the last intervals between two synchronization pulses is measured by means of a measurement shift register. The measurement shift register is clocked with the work pulses and, in the presence of a synchronization pulse at an input of the measurement shift register, a measurement pulse is set that is shifted by one position at each work clock pulse. At the next synchronization pulse, the bit pattern located in the measurement shift register is copied into a buffer register and the content of the measurement shift register is deleted. Located in the buffer register is thus a bit pattern in which only a single bit is set that corresponds to the measurement pulse, wherein this bit or this measurement pulse is separated from the input end of this by a specific number of positions that corresponds to the number of work clock pulses that have occurred between the two last successive synchronization pulses.

Within the scope of the exemplary embodiment it is naturally also possible to measure the number of work pulses between two synchronization pulses in a different manner. For example, a corresponding counter can be provided, wherein the count value is then buffered after expiration of the time interval. Within the scope of the exemplary embodiment it is also possible that the interval that corresponds to the prescribed duration that the processing device requires to act on the work piece is provided by other means than the synchronization pulse. For example, a timer can be correspondingly activated that activates a counter to count the work pulses.

The earlier output of the control pulses is advantageously executed such that all control pulses are delayed by a predetermined number of work pulses minus the number of work pulses that have been generated in the last interval. Via the delay of all control pulses by a predetermined number of work pulses that correspond to a predetermined path on the work piece, the individual control pulses can be output earlier by reducing the delay relative to their regular position. The chronological movement of the control pulses "forward" can thus be realized simply with this delay. In a preferred embodiment, this delay is executed by means of an output shift register in which the individual control pulses are entered by means of an or-link, wherein they are entered at a position in the output shift register that is offset by the maximum distance from the output, minus the number of work pulses that have been generated between the last interval.

Furthermore, the present exemplary embodiment concerns a device to execute the method according to the exemplary embodiment, and in particular a printing device. The device advantageously has a measurement shift register to measure the number of work pulses that have been generated in the last interval between two synchronization pulses; a buffer register that buffers the content of the measurement shift register; and an output shift register with which all control pulses are delayed by a predetermined number of work pulses minus the number of work pulses that have been generated in the last interval between two synchronization pulses.

The exemplary embodiments are explained in detail in the following and as shown in the drawings.

FIG. 1 shows a first exemplary embodiment of a device according to the invention to activate a processing device 1. A surface of a moving, web-shaped work piece 2 is processed at regular intervals with the processing device 1. A typical processing device is an inkjet print head of a printing device. Ink droplets are fired with this print head towards a surface of a recording medium. The recording medium represents the work piece 2. In high capacity printing machines, the recording medium is normally a paper web that is moved along the print head 1 at high velocity (for example 1.25 m/s). On the paper web the individual ink drops are applied in different sizes in a predetermined raster. This means that the ink drops are applied at a regular interval in the movement direction 3 of the paper web 2. The processing device 1 (the inkjet print head) should thus process the work piece 2 (the paper web) at regular intervals.

Since each ink drop requires a predetermined duration in order to eject from the inkjet print head 1 onto the recording medium 2, the processing of the recording medium 2 with regard to an activation signal to activate the inkjet print head 1 takes place with a time delay of a predetermined duration. This duration is the drop flight time ($t_{flight}$) that is calculated from the clearance between the inkjet print head 1 and the recording medium 2 ($s_{flight}$) and the velocity of the ink drop ($v_{flight}$). These parameters vary depending on the ink that is used, and in particular its viscosity, and on the type of recording medium and the arrangement of the inkjet print head relative to the recording medium 2. These parameters are known and allow the exact calculation of the drop flight time. The drop flight velocity ($v_{flight}$) is 5 m/s, for example, and the clearance ($s_{flight}$) is 1.5 mm, for example, such that a delay of 0.3 ms results.

The control device has a delay timer 4 that outputs an output signal proportional to the delay time δt. In the present exemplary embodiment, the delay time Δt corresponds to the drop flight time ($t_{flight}$). In the exemplary embodiment according to FIG. 1, the output signal of the delay timer 4 is a digital signal that outputs a numerical value describing the delay time Δt. Within the scope of the exemplary embodiment, it is naturally also possible that the delay timer 4 outputs an analog signal. Corresponding parameters of the processing device 1 are set at the delay timer 4, for example ink quality, paper quality and/or distance between the inkjet print head and the paper web; and the delay timer 4 calculates and outputs the delay time Δt.

The delay timer 4 relays the delay time Δt to a counter 5. The counter 5 is connected with an incremental sensor 6 that is used to scan the movement of the web-shaped work piece. The incremental sensor 6 is, for example, connected with a roller on which the web-shaped work piece 2 rests and that accordingly moves together with the movement of the work piece 2. The incremental sensor 6 generates work pulses, wherein a respective work pulse is generated when a shaft of the incremental sensor 6 is rotated by a predetermined rotation angle. The rotation angle corresponds to a defined path of the work piece 2. In a prototype of the present exemplary embodiment, the path of the work piece 2 between two work pulses amounts to 42.3 μm. Typical values for this spatial resolution lie in the range from 10 μm to 100 μm, and advantageously in the range from 20 μm to 60 μm.

The work pulses are supplied from the incremental sensor 6 to the counter 5. The counter 5 counts the respective arriving work pulses during the time interval Δt. After the time interval elapses, the numerical value C is relayed to a subtracter 7, and the counter begins to count the work pulses from the start during a new time interval of duration Δt.

In the subtracter 7, the counted value C is subtracted from a preset offset value Of. This preset offset value corresponds to a maximum delay. The result of this subtraction yields an offset value V that corresponds to the maximum delay, offset by the count value C.

Furthermore, the incremental sensor 6 is connected with a filter 8 that outputs only every n-th work pulse at its output side. These output pulses represent control pulses at the filter 8. The value of n is selected so that the path that the work piece 2 travels between two control pulses corresponds exactly to the regular interval with which the surface of the work piece 2 is to be processed. Control pulses that could be used to activate the processing device 1 are thus output by the filter 8 in order to ensure the processing of the surface at the predetermined regular interval if the work piece 2 were moved with constant velocity.

However, since the paper web 2 does not always move with constant velocity, the control pulses output by the filter 8 are used at the start of a decrementer in which the offset value V determined by the subtracter 7 is entered. The decrementer 9 is clocked with the work pulses so that the value of the work counter is reduced by one with each work pulse. If the content of the decrementer 9 is zero, an activation signal is output to the processing device 1 by the decrementer. The processing is hereby triggered by means of the processing device 1.

Since additional control pulses can already be output by the filter 8 before the decrementer 9 has reached a value of zero, multiple decrementers 9 are advantageously provided that can simultaneously be in operation. All decrementers 9 are clocked with the work pulses. Each time the filter 8 outputs a control pulse, one of the decrementers 9 is started with the last delay value V calculated by the subtracter 7. Each decrementer 9 counts the duration until a corresponding control pulse is output as an activation signal to the processing device 1. The multiple decrementers thus correspond to a series of control pulses that are output successively to the processing device as activation signals.

The output or relaying of the control pulses to the processing device 1 is delayed by the decrementers 9 since an activation signal is only output when the decrementers 9 have counted the respective delay value V until zero. This delay corresponds to a predetermined number of work pulses—the offset value—minus the count value C of the counter 5. With this count value C, the number of work pulses is counted that are generated between the intervals of the time delay of the processing of the work piece. This number of work pulses is a value for the path that the work piece 2 travels during the delay of the processing. Since this count value is subtracted from the offset value, the output of the control pulse to the processing device is offset forward in time relative to the offset value. At a higher velocity of the work piece 2, the control pulses are thus output earlier than at a lower velocity of the work piece 2.

This method can be realized very simply and operated very exactly. This enables the processing of the work piece even during an acceleration or slowing phase of the work piece. The regular intervals with which the surface of the work piece should be processed are maintained exactly.

The exemplary embodiment shown in FIG. 1 can be realized simply via corresponding digital circuits, or also via a computer program that can be executed on a microprocessor.

Figure 2:
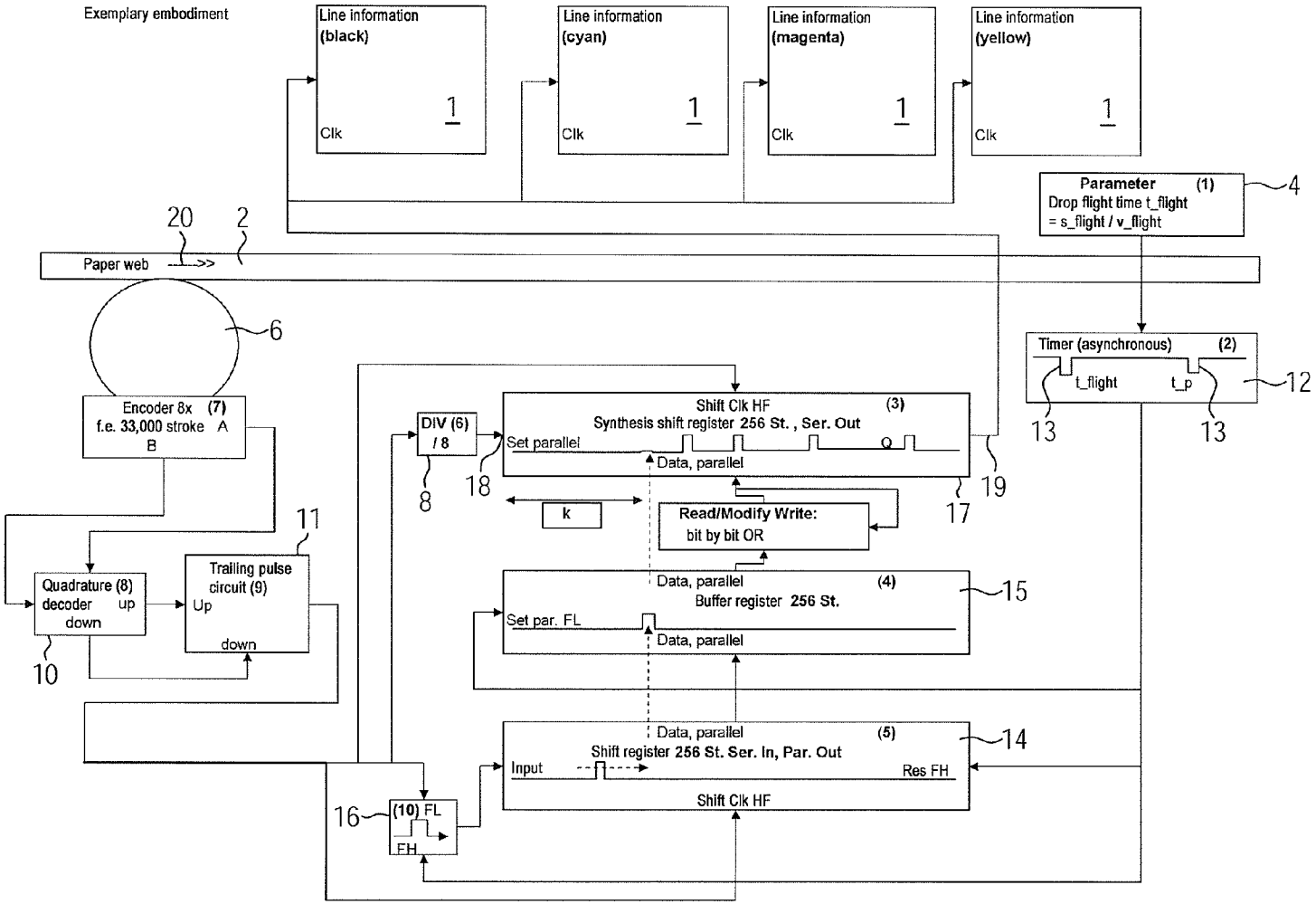
FIG. 2 is an additional device to activate a processing device according to a second exemplary embodiment, in a block diagram.

FIG. 2 shows a second exemplary embodiment of a device according to the exemplary embodiment to activate a processing device 1. This exemplary embodiment operates according to the same function principle as the first exemplary embodiment, which is why the same parts are also identified with the same reference characters.

This device in turn comprises an incremental sensor 6 that is coupled to a web-shaped work piece—in particular to a paper web 2—in order to detect the movement of the work piece 2. With this device, multiple processing devices 1 are activated that are respectively designed as inkjet print heads and shoot ink with different colors towards the recording medium 2 forming the work piece. The incremental sensor 6 is connected with a circuit described in DE 10 2009 038 480. The incremental sensor 6 generates two phase-offset output signals that are supplied to a quadrature decoder 10. The quadrature decoder generates two digital output signals with two respective signal levels, wherein one of the signals is generated only given a movement of the paper web in the forward direction 20, and the other of the output signals is generated only given an opposite, backward movement of the paper web 2. Each change between the signal levels corresponds to a web movement by a specific distance. The two signals can also be designated as forward signal (up) and backward signal (dn).

An evaluation circuit 11 generates work pulses from these two signals. The evaluation circuit 11 has a first counter that counts the signal change of the forward signal (up) and subtracts from this the signal change of the backward signal (dn); and a second counter that counts the signal changes of the work pulses. A comparator compares the values of the first and second counter with one another, and an inhibitor releases the forward signal (up) given the same values of the two counters, such that the forward signal is output as a work pulse. Given different values of the two counters, the forward signal (up) is blocked so that no work pulse is output.

This circuit has the effect that work pulses are output by the evaluation circuit 11 only given a forward movement of the work piece 2. It is hereby ensured that, given an unwanted backward movement of the work piece 2, no unwanted work pulses are generated that could cause errors. This circuit is described in more detail in the German Patent Application DE 10 2009 038 480, which is why the full content of this is referenced here.

The device according to the second exemplary embodiment in turn has a delay timer 4 that is connected with a pulse emitter 12. The pulse emitter 12 generates synchronization pulses 13 that are respectively spaced apart from one another by a delay time period ($t_{flight}$). This interval of the synchronization pulses 13 thus represents a different form of representing the delay time period ($t_{flight}$). The pulse emitter 12 can thus be considered a component of the delay time emitter 4.

A measurement shift register 14 and a buffer register 15 are provided to measure the number of work pulses between two synchronization pulses 13.

The measurement shift register 14 is clocked with the work pulses. The measurement shift register 14 has an input that is connected with a gate. Both the signal of the synchronization pulses 13 and the signal of the work pulses are supplied to the gate 16. If a synchronization pulse is applied to the gate 16, the gate is released and the next work pulse is passed through the gate 16 to the input of the measurement shift register 14. The gate is subsequently closed again until the next synchronization pulse. This work pulse is entered as a measurement pulse into the bit pattern at the leftmost position at the input into the measurement shift register 14. With each work clock, the bit pattern is shifted by one position to the right with the measurement pulse in the measurement shift register 14.

Both the measurement shift register 14 and the buffer register 15 are linked with the signal of the synchronization pulses 13. If a synchronization pulse is applied to these two registers 14, 15, with the measurement pulse the buffer register 15 reads out the bit pattern of the measurement shift register 14 and stores it. A bit pattern that was previously located in the buffer register 15 is overwritten. The measurement shift register 14 is thus imported in parallel. After the readout of the measurement shift register 14, the content of the measurement shift register is deleted in order to read out the next work pulse.

Via the gate 16 it is ensured that the importation of a work pulse takes place with a short time offset to delete the measurement shift register 14.

The bit pattern stored in the buffer register 15 includes only a single set bit (the measurement pulse), wherein the measurement pulse is located at the position that is separated from the left edge of the bit pattern by the number of work pulses between the two most recent synchronization pulses. This distance of the set bit from the left edge of the bit pattern thus reflects the number of work pulses generated between the last two synchronization pulses. The number of work pulses between the synchronization pulses (i.e. within the predetermined time duration of the delay time) can thus be measured repeatedly with the two registers 14, 15 and is stored in the buffer register 15 until the next measurement.

The device furthermore comprises an output shift register 17 that is clocked just like the measurement shift register 14 by means of the work pulses, and a bit pattern contained therein is shifted to the right by one position at each work pulse. The output shift register 17 is a register with a serial output 19 at which is applied the respective last bit shifted from the extreme right edge of the bit pattern to the output. An input 18 of the output shift register 17 is connected with a filter 8 that functions just like the filter 8 of the first exemplary embodiment and only lets every n-th control pulse pass as a control pulse, and applies it to the input 18 of the output shift register. The output shift register 17 is wired with the buffer register 15 such that the bit pattern of the buffer register 15 is transferred to the bit pattern of the output shift register 17 with an or-link. The respective single set bit of the buffer register 15 is hereby written to the corresponding position of the output shift register 17, and the already present set bit of the output register 17 is not modified.

If a control pulse is applied at the input 18 of the output shift register 17, an additional bit is set in the output shift register 17, wherein its position is offset from the left edge of the bit pattern by the number of work pulses that have been generated between the last two synchronization pulses. The individual set bits are shifted to the left in the output shift register 17 with each work pulse and are output successively at the output 19, and there are relayed to one or more of the processing devices 1.

The number of all positions of the bit pattern of the output shift register 17 corresponds to the offset value Of the first exemplary embodiment. The offset of the single bit set in the buffer register 15 from the left edge of the respective bit pattern corresponds to the counter value C of the first exemplary embodiment. The faster that the work piece 2 is moved, the larger this offset and the earlier that the respective bit arrives at the output 19 of the output shift register 17 to be output as an activation signal.

The circuit shown in FIG. 2 is a very elegant and fast hardware circuit with which the delay in the processing of the work piece can be corrected by the processing device with low technical cost, such that the processing can be executed with exact positioning on the work piece 2 during both an acceleration phase and a slowing phase of the work piece 2.

Although preferred exemplary embodiments are shown and described in detail in the drawings and in the preceding specification, they should be viewed as purely exemplary and not as limiting the invention. It is noted that only preferred exemplary embodiments are shown and described, and all variations and modifications that presently or in the future lie within the protective scope of the invention should be protected.

I claim:

1. A method to activate a processing device which processes a surface of a moving, web-shaped work piece at regular intervals, wherein a predetermined time duration passes between a respective activation signal of the processing device and the processing on the surface of the web-shaped work piece, comprising the steps of:

sensing the movement of the web-shaped work piece with an incremental sensor that generates work pulses, and generating a respective control pulse if a predetermined number of work pulses that correspond to a predetermined path of the web-shaped work piece has been generated, said path corresponding to said regular intervals to process the surface of the work piece, such that a series of control pulses is generated;

repeatedly detecting a number of the work pulses in a respective time interval that corresponds to the predetermined time duration;

generating the activation signals wherein each activation signal is respectively generated at each control pulse of the series of control pulses, and the activation signals being offset forward in time relative to the respective control pulse corresponding to the number of work pulses that have been detected in a preceding time interval;

outputting the activation signals to the processing device;

the respective time interval that corresponds to the predetermined time duration being provided via synchronization pulses with a corresponding time interval; and the number of work pulses that have been generated between a last interval between two synchronization pulses being measured by means of a measurement shift register, wherein said measurement shift register being clocked with the work pulses, and given presence of a synchronization pulse a measurement pulse is set at an input of the measurement shift register, which measurement pulse is shifted by one position at every work clock, wherein at a next synchronization pulse a bit pattern located in the measurement shift register is copied into a buffer register and a content of said measurement shift register is deleted.

2. The method according to claim 1 wherein a print head of a printing device is used as the processing device and a recording medium to be printed is used as the work piece, and wherein the print head is an inkjet print head.

3. A method to activate a processing device which processes a surface of a moving, web-shaped work piece at regular intervals, wherein a predetermined time duration passes between a respective activation signal of the processing device and the processing on the surface of the web-shaped work piece, comprising the steps of:

sensing the movement of the web-shaped work piece with an incremental sensor that generates work pulses, and generating a respective control pulse if a predetermined number of work pulses that correspond to a predetermined path of the web-shaped work piece has been generated, said path corresponding to said regular intervals to process the surface of the work piece, such that a series of control pulses is generated;

repeatedly detecting a number of the work pulses in a respective time interval that corresponds to the predetermined time duration;

generating the activation signals wherein each activation signal is respectively generated at each control pulse of the series of control pulses, and the activation signals being offset forward in time relative to the respective control pulse corresponding to the number of work pulses that have been detected in a preceding time interval;

outputting the activation signals to the processing device; and wherein an earlier output of the control pulses is executed such that all control pulses are delayed by a predetermined number of work pulses minus a number of work pulses that have been generated between a last interval between two synchronization pulses.

4. The method according to claim 3 wherein the delay of the control pulses is executed by means of an output shift register that is clocked with the work pulses in order to shift a bit pattern contained therein by one position in a direction towards a serial output of said shift register at every clock pulse, wherein upon application of a control pulse at an input of the output shift register said control pulse is entered into the shift register at a position that, in the bit pattern, is a maximum distance from the output minus the number of work pulses that have been generated between the last interval between the two synchronization pulses.

5. The method according to claim 4 wherein the entry of the control pulse into the output shift register takes place in that, upon application of the control pulse at the input of the output shift register, a bit pattern of a buffer register is transferred to the bit pattern of the output shift register by means of an or-link.

6. The method according to claim 4 wherein the control pulses are supplied to multiple processing devices to activate said processing devices.

7. A method to process a moving web-shaped work piece at regular intervals, comprising the steps of:

providing a processing device that acts on the work piece for the predetermined time delay relative to an activation signal;

providing an incremental sensor to scan a movement of the web-shaped work piece and to output corresponding work pulses;

providing a pulse emitter to generate at least two successive synchronization pulses that are separated from one another by a delay time;

providing a measurement shift register coupled to the pulse emitter and to the incremental sensor, and with the measurement shift register generating a measurement pulse between said two successive synchronization pulses, said measurement pulse being offset by a number of said work pulses between the two successive synchronization pulses;

providing a buffer register to store the measurement pulse with the offset;

providing an output shift register having a filter connected at a first input such that every n-th work pulse of said work pulses is let pass by the filter as a first control pulse applied at said first input of the output shift register, said output shift register being connected at a second input with the buffer register via an or-link; and transferring via said or-link the measurement pulse as a second control pulse to the output shift register, the output shift register being clocked with the work pulses of said incremental sensor so that if said first control pulse is applied at said first input of the output shift register a bit pattern of the output shift register is shifted with the control pulses by one position in a direction towards an output of the output shift register, and wherein each control pulse is output as said activation signal to said processing device.

* * * * *